US007363914B2

(12) United States Patent
Hoffmann et al.

(10) Patent No.: US 7,363,914 B2
(45) Date of Patent: Apr. 29, 2008

(54) SOLENOID ACTUATED FUEL INJECTOR HAVING A PRESSURE BALANCED PINTLE

(75) Inventors: Guy Hoffmann, Sandweiler (LU); Frank A Clerx, Luxembourg (LU); Hugues M J G Wanlin, Bertrix (BE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/592,025

(22) Filed: Nov. 2, 2006

(65) Prior Publication Data

US 2007/0095954 A1 May 3, 2007

(30) Foreign Application Priority Data

Nov. 2, 2005 (EP) ..... 05256795

(51) Int. Cl.
*F02M 59/46* (2006.01)
*F02M 59/44* (2006.01)

(52) U.S. Cl. ..... 123/467; 123/305

(58) Field of Classification Search ..... 123/467, 123/305; 239/88–92, 533.1, 533.2, 533.8, 239/533.9, 533.12, 585.1, 533.7, 453
See application file for complete search history.

(56) References Cited

U.S. PATENT DOCUMENTS 3,450,353 A * 6/1969 Eckert ..... 239/585.2
4,341,351 A * 7/1982 DeLuca ..... 239/453
4,511,082 A * 4/1985 Ballik et al. ..... 239/8
4,708,289 A * 11/1987 Szablewski et al. ..... 239/125
5,400,970 A * 3/1995 Alt et al. ..... 239/408
5,823,161 A * 10/1998 Potz et al. ..... 123/305
6,036,120 A * 3/2000 Varble et al. ..... 239/585.1
6,910,851 B2 * 6/2005 Franconi et al. ..... 415/115
2001/0032893 A1 * 10/2001 Lambert ..... 239/533.3

* cited by examiner

*Primary Examiner*—Mahmoud Gimie
(74) *Attorney, Agent, or Firm*—Patrick M. Griffin

(57) ABSTRACT

A fuel injector for an internal combustion engine, the injector comprising an injector body having a tip portion defining at least one spray aperture; a pintle extending within the tip portion, the pintle having a head portion engageable with a valve seat to close the spray aperture, the pintle being axially moveable between a closed position wherein the head portion abuts the valve seat and an open position wherein the head portion is spaced from the valve seat; actuating means for selectively urging the pintle towards its open position; guide means being provided within the injector body guiding the pintle for axial movement between its closed and open positions; a fuel supply chamber being defined within the injector body between the spray aperture and the guide means, characterized in that the diameters of the guide means and valve seat are selected such that the pintle is substantially pressure balanced.

12 Claims, 1 Drawing Sheet

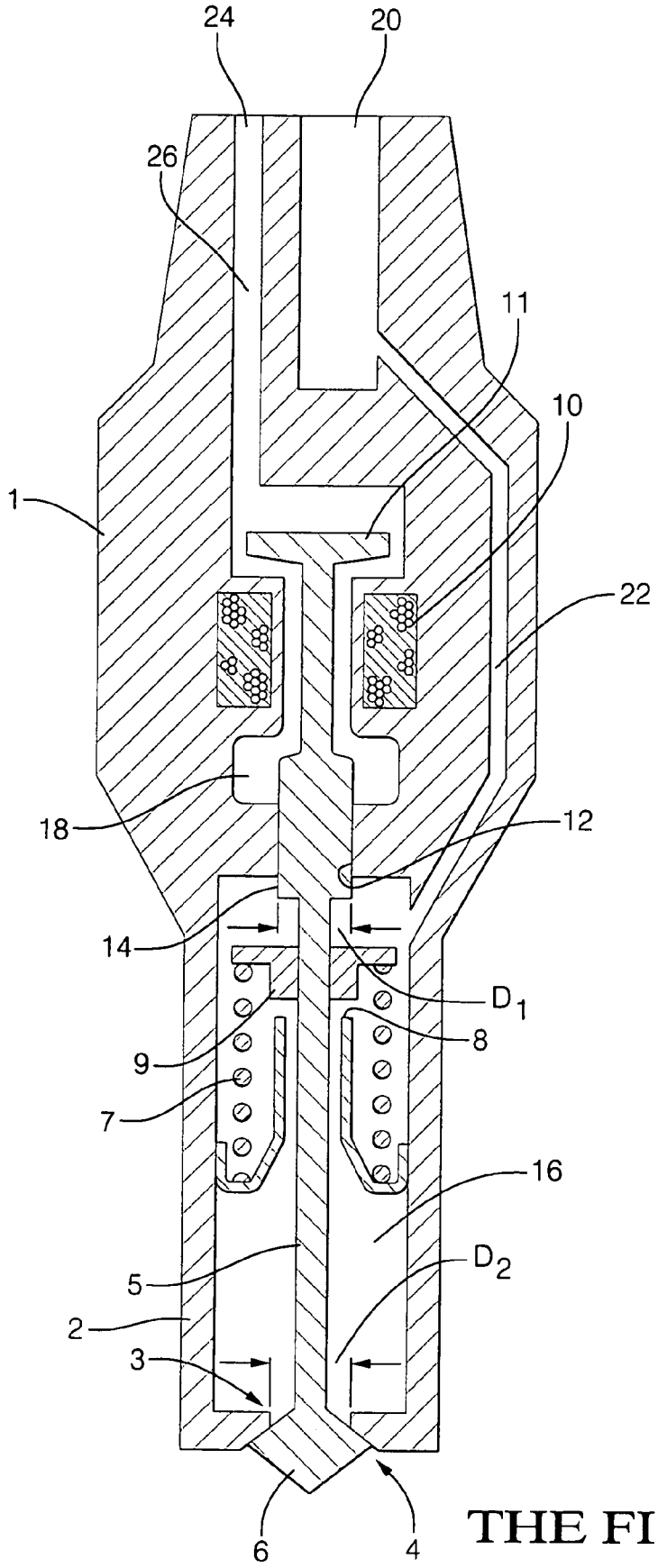
THE FIGURE

SOLENOID ACTUATED FUEL INJECTOR HAVING A PRESSURE BALANCED PINTLE

TECHNICAL FIELD OF INVENTION

The present invention relates to a fuel injector and in particular to a fuel injector for direct injection of gasoline into the combustion chamber of an internal combustion engine.

BACKGROUND OF INVENTION

Modern direct injection gasoline engines require fuel injectors to operate under extreme conditions of temperature and pressure and with high fuel pressures. Furthermore, the fuel injector must open and close very rapidly in order to provide multi-pulse injection cycles required for fuel efficiency and low emissions.

Current high pressure direct injection fuel injectors either use inwardly opening valves (nozzle type or multi-hole director) in conjunction with solenoid actuation or outwardly opening valves using piezo-electric actuation. The outwardly opening piezo-electric actuated injector has demonstrated the highest potential for reducing fuel consumption, but the cost of the piezo-stack and driver is prohibitive for high volume applications.

Known outwardly opening piezo-electric actuated fuel injectors generally comprise a valve body having a tip portion defining a spray aperture, a pintle or valve stem extending within the tip portion for axial movement between an extended and a retracted position, the pintle having an external head engageable with the spray aperture to close the spray aperture when the pintle is in its retracted position, a return spring biasing the pintle towards its retracted position, an actuating means in the form of a piezo-stack, acting upon the pintle to urge the pintle to its extended position when the piezo-stack is energised.

The piezo-stack can provide a high opening force to overcome the strong return spring required to hold the valve closed and the high hydraulic forces generated during the high pressure operation of the injector, can provide rapid valve opening and achieves variable valve lift. However, piezo-electric fuel injectors are very costly to produce compared to solenoid actuated injectors and require complex and costly control systems for operation of the piezo-stack.

By contrast, solenoid actuated fuel injectors are much cheaper to produce. However, known solenoid actuated fuel injectors cannot provide the same level of performance as piezo-electric actuated devices, mainly due to the lower opening force achievable by electromagnetic solenoid actuators and the slower rise of force over time. The low opening force of a solenoid renders such unsuitable for high pressure operating outwardly opening injectors because the solenoid cannot overcome the strong return spring required to prevent opening of the valve under the effect of the fuel pressure upstream of the valve, especially during start up when the fuel pressure is lower.

SUMMARY OF THE INVENTION

An object of the present invention is to provide a solenoid actuated fuel injector that achieves the same performance as a piezo-electric actuated device.

According to the present invention there is provided a fuel injector for an internal combustion engine, the injector comprising an injector body having a tip portion defining at least one spray aperture; a pintle extending within the tip portion, the pintle having a head portion engageable with a valve seat to close the spray aperture, the pintle being axially moveable between a closed position wherein the head portion abuts the valve seat and an open position wherein the head portion is spaced from the valve seat; actuating means for selectively urging the pintle towards its open position; guide means being provided within the injector body guiding the pintle for axial movement between its closed and open positions; a fuel supply chamber being defined within the injector body between the spray aperture and the guide means, wherein the dimensions of the guide means and valve seat and the portions of the pintle cooperating therewith are selected such that the pintle is substantially pressure balanced when the pintle is in its closed position or such that the pintle is subjected to a predetermined resultant opening or closing force when the pintle is in its closed position and pressurised fuel is supplied to the fuel supply chamber.

Preferably the inner diameter of the valve seat is substantially equal to the inner diameter of the guide means so that the pintle is pressure balanced with no resultant force acting on the pintle due to fuel pressure within the fuel supply chamber when the pintle is in its closed position.

In a preferred embodiment the fuel injector is an outwardly opening fuel injector wherein the pintle moves from its closed to its open position in the direction of fuel flow. Preferably the actuating means comprises a solenoid.

Preferably the guide means divides the interior of the injector body into a high pressure side and a low pressure side, the high pressure side being adapted for connection to a supply of high pressure fuel and the low pressure side being adapted to connection to a suitable low pressure drain or fuel return.

The pintle may be match ground with the guide means to minimise leakage of high pressure fuel past the guide means and/or seal means, such as a PTFE seal, may be provided between the guide means and the pintle to minimise leakage.

In one embodiment the dimensions and material of the pintle may be selected to obtain a predetermined extension or stretch of the pintle as a function of fuel pressure within the fuel supply chamber to provide an increase in the stroke of the pintle between its closed and open positions in proportion to increasing pressure within the fuel supply chamber. Preferably the dimensions and material of the pintle are selected to obtain an increase in pintle stroke of approximately 10 μm when the fuel pressure within the fuel supply chamber increases from 50 bar to 200 bar.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

The present invention will now be described, by way of example, with reference to the accompanying drawing, in which:

FIG. 1 is a sectional view of a fuel injector according to a preferred embodiment of the present invention.

DETAILED DESCRIPTION OF INVENTION

As shown in the drawing, the fuel injector comprises an injector body 1 having a tip portion 2 having a spray aperture 3 at a distal end thereof. A pintle 5 extends within the tip portion 2, the pintle 5 having a head portion 6 engageable with a valve seat 4 surrounding the spray aperture 3 to close the spray aperture 3. The pintle 5 is axially moveable within the injector body 1 between a retracted position wherein the head portion 6 engages the valve seat 4, as shown in FIG. 1, and an extended position (not shown) wherein the head portion 6 is spaced from the valve seat 4. A return spring 7 is mounted within the tip portion, biasing the pintle 5 towards its retracted position. An end stop 8 mounted on the injector housing 1 cooperates with a collar 9 on the pintle to limit the extension of the pintle 5 and define the extended position of the pintle 5.

An actuator, such a solenoid having an electromagnetic coil 10 and a moveable armature 11, is operable to urge the pintle 5 to its extended position.

A bore 12 defines a guide through which a portion 14 of the pintle 5 is a close sliding fit. The bore 12 and the cooperating portion 14 of the pintle 5 may be match ground to minimise leakage of high pressure fuel past the bore 12.

The bore 12 divides the interior of the injector housing 1 into a high pressure side 16 and a low pressure side 18. A high pressure fuel inlet 20 communicates with the high pressure side 16 of the injector housing via a passageway 22 while a lower pressure fuel drain or return 24 communicates with the low pressure side via a passageway 26.

The diameter of the bore 12 is selected to be substantially equal to the diameter of the inner edge of the valve seat 4, thus avoiding any net opening or closing force on the pintle 5 as a result of fluid pressure within the high pressure side 16 of the injector housing 1, which might otherwise act against the return spring 7 and cause the valve to "pop open" if the any resultant opening force where to equal or exceed the closing force of the spring. In this way, the pintle 5 is pressure balanced.

Since the return spring 7 does not have to counter an resultant opening pressure due to the presence of high pressure fuel within the injector housing, the spring need only be strong enough to close the valve. By way of example, in order to counter a resultant opening force acting against the head portion of the pintle in a non-pressure balanced system, a return spring must be capable of exerting a closing force of more than 180 N for a fuel operating pressure of 200 bar to avoid the risk of the valve "popping" open. Such opening force cannot normally be achieved via a solenoid suitable for the high opening response required for a fuel injector, and thus more expensive piezo-electric actuators would normally be required. By pressure balancing the pintle in accordance with the present invention, the force of the return spring can be reduced to the closing force required for sealing and required closing reponse, enabling the valve to be readily opened by a solenoid.

If required, a net closing or opening force can be generated proportional to the system pressure by varying the ratio of the diameter D1 of the pintle guide bore 12 to the valve seat diameter D2. By selecting D1 to be greater than D2 a net closing force can be achieved. Conversely, by selecting D2 to be greater than D1 a net opening force can be achieved. Depending on the design goals, these effects can be used, for example, to assist closing response at higher/lower system pressure or to avoid valve opening due to pressure pulsations. It is also envisaged that pressure differentials between the combustion chamber and the drain/return line may be compensated for by an appropriate choice of D1 and D2.

In an alternative embodiment (not shown), rather than, or in addition to, match grinding the guide bore 12 and the cooperating portion 14 of the pintle 5, a PTFE seal may be located between the guide bore 12 and portion 14.

Whilst the present invention provides for a zero or small predetermined resultant force on the pintle in an opening and/or closing direction, there are still forces acting upon on the pintle when the high pressure side of the injector body is pressurised with high pressure fuel. The force of fuel acting on the pintle head 6 is countered by the force of fuel acting on the portion 14 of the pintle 5. While such forces may produce no resultant force on the pintle in the opening or closing direction, they do act to place the pintle in tension.

Surprisingly, it has been found that, by careful selection of the material and dimensions of the pintle, including the pintle stiffness, such tension force can be utilised to prove a variation in the stroke of the pintle as a function of the fuel pressure within the high pressure side of the injector housing.

Fuel injectors are required to provide a wide range of injected fuel quantities between minimum linear flow and maximum linear flow. The dynamic range of a fuel injector can be enhanced by varying the pressure of the fuel supplied to the injector. Higher pressure fuel can be used to deliver higher flow rates of fuel while smaller flow rates (and thus fuel quantities delivered) can be achieved using a lower fuel supply pressure. Current high pressure injectors use up to 200 bar maximum system pressure with pressure modulation down to between 50 bar to 100 bar. In addition to pressure modulation, piezo-electric actuated injectors are able to further vary the flow rate by varying the valve/pintle stroke by reducing the piezo-stack drive voltage.

In order to increase the dynamic range of a fuel injector, it is beneficial to reduce pintle stroke and system pressure simultaneously. The present invention achieves this goal without any additional components.

As discussed above, the upper and lower faces of the pintle remain at or close to ambient pressure. As the fuel pressure within the high pressure side of the injector is increased, a compression force is exerted on sides the pintle causing the pintle to elongate and increase in length.

In a preferred embodiment, the dimensions, material and stiffness of the pintle are selected to achieve a stroke increase of approximately 10 μm for a pressure increase from 50 μm to 200 bar, to give a 50 bar stroke of 20 μm and a 200 bar stroke of 30. The main benefit of a stroke reduction is due to reduced flight times of the pintle and armature leading to quicker opening and closing of the injector, thus extending the linear flow range of the injector, and also due to a reduction in static fuel flow when the pintle is in its extended position.

While this invention has been described in terms of the preferred embodiments thereof, it is not intended to be so limited, but rather only to the extent set forth in the claims that follow.

We claim:

1. A fuel injector for an internal combustion engine, the injector comprising an injector body having a tip portion defining at least one spray aperture; a pintle extending within the tip portion, the pintle having a head portion engageable with a valve seat to close the spray aperture, the pintle being axially moveable between a closed position wherein the head portion abuts the valve seat and an open position wherein the head portion is spaced from the valve seat; actuating means for selectively urging the pintle towards its open position; guide means being provided within the injector body guiding the pintle for axial movement between its closed and open positions; a fuel supply chamber being defined within the injector body between the spray aperture and the guide means, characterised in that the guide means has an inner diameter D1 and the valve seat has an inner diameter D2 and the ratio of D1 to D2 is selected such that the pintle is substantially pressure balanced and thereby subjected to a predetermined resultant opening/closing force when the pintle is in its closed position and pressurised fuel is supplied to the fuel supply chamber.

2. A fuel injector as claimed in claim 1, wherein the inner diameter D2 of the valve seat is substantially equal to the inner diameter D1 of the guide means.

3. A fuel injector according to claims 1 or 2, wherein the pintle moves from its closed to its open position in the direction of fuel flow.

4. A fuel injector as claimed in claim 3 wherein the actuating means comprises a solenoid.

5. A fuel injector as claimed in claim 3, wherein the guide means divides the interior of the injector body into a high pressure side and a low pressure side, the high pressure side being adapted for connection to a supply of high pressure fuel and the low pressure side being adapted to connection to a suitable low pressure outlet.

6. A fuel injector as claimed in claim 3, wherein the pintle is match ground with the guide means to minimise leakage of high pressure fuel past the guide means.

7. A fuel injector as claimed in claim 3 wherein seal means are provided between the guide means and the pintle to minimise leakage.

8. A fuel injector as claimed in claim 7, wherein the seal comprises a PTFE seal to minimise friction.

9. A fuel injector for an internal combustion engine, the injector comprising an injector body having a tip portion defining at least one spray aperture; a pintle extending within the tip portion, the pintle having a head portion engageable with a valve seat to close the spray aperture, the pintle being axially moveable between a closed position wherein the head portion abuts the valve seat and an open position wherein the head portion is spaced from the valve seat; actuating means for selectively urging the pintle towards its open position; guide means being provided within the injector body guiding the pintle for axial movement between its closed and open positions; a fuel supply chamber being defined within the injector body between the spray aperture and the guide means, characterised in that the dimensions of the guide means and valve seat and the portions of the pintle cooperating therewith are selected such that the pintle is substantially pressure balanced and thereby subjected to a predetermined resultant opening/closing force when the pintle is in its closed position and pressurised fuel is supplied to the fuel supply chamber;

wherein the inner diameter of the valve seat is substantially equal to the inner diameter of the guide means;

wherein the pintle moves from its closed to its open position in the direction of fuel flow; and wherein dimensions and material of the pintle are selected to obtain a predetermined extension of the pintle as a function of fuel pressure within the fuel supply chamber to provide an increase in the stroke of the pintle between its closed and open positions in proportion to increasing pressure within the fuel supply chamber.

10. A fuel injector for an internal combustion engine, the injector comprising an injector body having a tip portion defining at least one spray aperture; a pintle extending within the tip portion, the pintle having a head portion engageable with a valve seat to close the spray aperture, the pintle being axially moveable between a closed position wherein the head portion abuts the valve seat and an open position wherein the head portion is spaced from the valve seat; actuating means for selectively urging the pintle towards its open position; guide means being provided within the injector body guiding the pintle for axial movement between its closed and open positions; a fuel supply chamber being defined within the injector body between the spray aperture and the guide means, characterised in that the dimensions of the guide means and valve seat and the portions of the pintle cooperating therewith are selected such that the pintle is substantially pressure balanced and thereby subjected to a predetermined resultant opening/closing force when the pintle is in its closed position and pressurised fuel is supplied to the fuel supply chamber;

wherein the inner diameter of the valve seat is substantially equal to the inner diameter of the guide means;

wherein the pintle moves from its closed to its open position in the direction of fuel flow;

wherein seal means are provided between the guide means and the pintle to minimise leakage;

wherein the seal comprises a PTFE seal to minimise friction; and wherein the dimensions and material of the pintle are selected to obtain an increase in pintle stroke of approximately 10 μm when the fuel pressure within the fuel supply chamber increases from 50 bar to 200 bar.

11. A fuel injector for an internal combustion engine, the injector comprising an injector body having a tip portion defining at least one spray aperture; a pintle extending within the tip portion, the pintle having a head portion engageable with a valve seat to close the spray aperture, the pintle being axially moveable between a closed position wherein the head portion abuts the valve seat and an open position wherein the head portion is spaced from the valve seat; actuating means for selectively urging the pintle towards its open position; guide means being provided within the injector body guiding the pintle for axial movement between its closed and open positions; a fuel supply chamber being defined within the injector body between the spray aperture and the guide means, characterised in that the dimensions of the guide means and valve seat and the portions of the pintle cooperating therewith are selected such that the pintle is substantially pressure balanced and thereby subjected to a predetermined resultant opening/closing force when the pintle is in its closed position and pressurised fuel is supplied to the fuel supply chamber;

wherein the pintle moves from its closed to its open position in the direction of fuel flow; and wherein dimensions and material of the pintle are selected to obtain a predetermined extension of the pintle as a function of fuel pressure within the fuel supply chamber to provide an increase in the stroke of the pintle between its closed and open positions in proportion to increasing pressure within the fuel supply chamber.

12. A fuel injector for an internal combustion engine, the injector comprising an injector body having a tip portion defining at least one spray aperture; a pintle extending within the tip portion, the pintle having a head portion engageable with a valve seat to close the spray aperture, the pintle being axially moveable between a closed position wherein the head portion abuts the valve seat and an open position wherein the head portion is spaced from the valve seat; actuating means for selectively urging the pintle towards its open position; guide means being provided within the injector body guiding the pintle for axial movement between its closed and open positions; a fuel supply chamber being defined within the injector body between the spray aperture and the guide means, characterised in that the dimensions of the guide means and valve seat and the portions of the pintle cooperating therewith are selected such that the pintle is substantially pressure balanced and thereby subjected to a predetermined resultant opening/closing force when the pintle is in its closed position and pressurised fuel is supplied to the fuel supply chamber;

wherein the pintle moves from its closed to its open position in the direction of fuel flow;

wherein seal means are provided between the guide means and the pintle to minimise leakage; and wherein the seal comprises a PTFE seal to minimise friction; and wherein the dimensions and material of the pintle are selected to obtain an increase in pintle stroke of approximately 10 μm when the fuel pressure within the fuel supply chamber increases from 50 bar to 200 bar.

* * * * *